United States Patent [19]

Hill et al.

[11] 3,951,411

[45] Apr. 20, 1976

[54] BOARD GAME APPARATUS

[76] Inventors: Christopher Hill, 7 Eastbury Road, Kingston, Surrey; Charles Baker, 38 Pepys Road, London, SW20; Leonard Blundun, 44 Claremont Road, London, E.7, all of England

[22] Filed: Sept. 23, 1974

[21] Appl. No.: 508,627

[30] Foreign Application Priority Data

Sept. 21, 1973 United Kingdom ..... 44328/73

[52] U.S. Cl. ..... 273/134 AD; 273/134 B; 273/134 C; 273/134 D; 273/134 AT

[51] Int. Cl.[2] ..... A63F 3/00

[58] Field of Search ..... 273/134

[56] References Cited

UNITED STATES PATENTS

| | | | |
|---|---|---|---|
| 2,165,891 | 7/1939 | Freedman | 273/134 C |

FOREIGN PATENTS OR APPLICATIONS

| | | | |
|---|---|---|---|
| 586,817 | 4/1947 | United Kingdom | 273/134 C |
| 1,261,391 | 4/1961 | France | 273/134 AD |

*Primary Examiner*—Delbert B. Lowe

*Attorney, Agent, or Firm*—Larson, Taylor and Hinds

[57] ABSTRACT

A board game for two or more players simulating the popular conception of espionage. A set of pieces is allotted to each player who must play on an outer part of the board to collect them in order to play on an inner part of the board. The game is played with advantages and forfeits, the object of the game being for each player to capture a selected piece of an opposing player. The board is set out in sectors divided symbolically by barriers which can be bridged to move in an opposing player's sector.

10 Claims, 7 Drawing Figures

BOARD GAME APPARATUS

This invention is concerned with improvements in or relating to board games and is especially concerned with a board game which is based on the popular conception of espionage and spying.

The present invention provides a board game comprising a board having a first section on which a preliminary stage of the game is played and a second section on which a second stage of the game is played, a set of pieces for each player which are movable on the second section of the board, and a further piece for each player which, in playing the game, is moved along divisions of the first section to collect pieces of the set of pieces before that player can participate in the second stage of the game, the second section of the board being divided into a plurality of sectors and each sector being divided into a plurality of divisions for moving the pieces of each set across the board to secure a still further piece of an opposing player, said still further piece being located on a specific division of the opposing player's sector, and return it to a "safe" location, the game further comprising means for randomly controlling movement of each piece on the board, means providing advantages and forfeits during playing of the game, and rules determining the conduct of the game.

The board is preferably set out with the first section in the form of a peripheral circuit around the second section of the board, the divisions of the first section bearing either a symbol which identifies the division with a piece from the set of pieces to be collected, or a symbol indicating that an advantage or forfeit must be played, when a player's further piece lands thereon. The distribution of the symbols on the first section of the board may be regular or random, and may be governed by values of the pieces so symbolized; movement of the aforesaid further pieces on the first section of the board is governed by throwing a die.

The second section of the board is preferably divided into four sectors each coloured to indicate its association with a player and with the pieces associated with that player, and the barriers separating the four sectors may be artistic impressions of walls or barbed wire fences or the like across which the pieces can be moved into other sectors.

The means provided for randomly controlling the movement of each said further piece (or "secret agent" which that further piece represents) comprises the aforementioned die, and the means for randomly controlling movement of each piece of each set preferably comprises a second die having a number of possible choices of movement indicated thereon, and a further choice providing for the use of the means providing the aforesaid advantages and forfeits. Obviously other means for randomly controlling movements as aforesaid may be provided.

The means providing the forfeits and advantages preferably comprises packs of cards each bearing a letter or number on its reverse side inside a small dot which represents a microdot and which may itself form part of a word made up of a plurality of these small dots, the letter or number being viewed through a magnifying glass and providing a key letter or number to one or more instruction charts. Similarly, for the preliminary stage of the game, similar means are also provided for use in correspondingly marked divisions of the first section of the board.

Each of the pieces of each set is distinct from the other pieces of the set and these pieces may be in the form of models of articles such as a "spy" or "agent" might use, for example a gun, a dagger, earphone headset, a ladder, wirecutters and passport; other alternative pieces modelled as for example a stick of dynamite, a grenade, rope, or a camera may be used. Alternatively counters bearing symbols may be used, each article being allotted a value for the purpose of playing the game.

The game which has been selected to illustrate the invention by way of example is hereinafter described with reference to the accompanying drawings in which.

The board comprises two sections, namely, an outer peripheral section which extends entirely around the board, and a central section which is divided into four sectors, all of identical shape and size and each divided into a plurality of squares.

The outer peripheral section is also divided into a plurality of squares with a large square at each corner of the board and smaller squares between the large squares. Each of the smaller squares is marked in a distinctive manner which includes a symbol indicating the significance and/or the importance of the square. For example, each of eight smaller squares between two larger, corner squares along one side of the board may have thereon, as a symbol, a picture of any one of the following, a gun, a dagger, an earphone headset, a ladder, wire cutters, or a passport, the remaining two squares bearing a symbol of a large dot, itself symbolizing a microdot, and the legend briefing card. Each of these smaller squares can of course be embellished artistically to provide an eye-catching appearance. (More than eight squares and six symbols can be provided but we have found that these numbers are adequate).

Each of the larger, corner squares provides a "base" from which the game is started, each corner square being colour coded to correspond with the colour coding of the adjacent sector of the central section of the board, for example, red, green, blue or yellow. Each corner square includes an indication of the values of the symbols (and corresponding playing pieces) on the squares of the outer section of the board. An innermost corner of the corner square is marked "H.Q.", i.e., headquarters.

The four sectors of the central section of the board are separated by barriers, one represented as a wall and the other as a barbed wire fence, the barriers being at right angles to one another and their common square being a "checkpoint". Adjacent each square marked H.Q. the five nearest squares are denoted by, for example, a darker shade of colouring than the remaining squares of the sector for the purpose hereinafter described.

Figure 4:
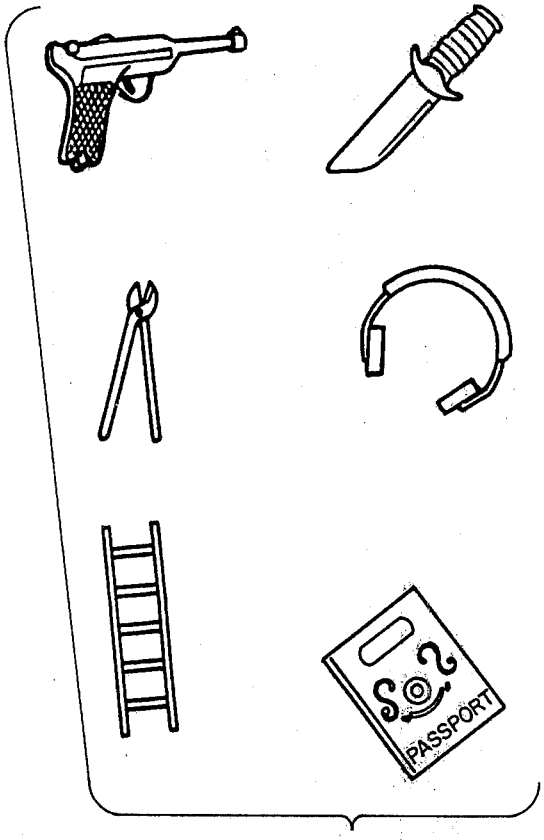
FIGS. 4 and 5 show pieces used in playing the game.

The game further comprises, for each player, a piece which is moved around the outer peripheral section of the board by throwing a conventional die, and a set of six other different pieces (FIG. 4) which correspond to the symbols on the outer peripheral section. Each piece is accorded a value, as, for example, the gun — 6, the dagger — 5, the earphones — 4, the ladder — 3, the wirecutters — 2, and the passport — 1. In addition to these pieces, there is further provided for use by all the players a second die marked on its faces with a number of possible choices to be taken according to the position of the die when it comes to rest. These, and their function, will be described later. A third die marked with three black and three white squares is also provided for the purpose described hereinafter.

Figure 5:
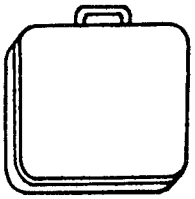

The game is played in the following manner:

Each player selects a piece, or agent, of a specific colour and places the agent on his corner square on the board. The other six pieces, namely, the passport, wirecutters, ladder, earphones, dagger and gun, providing the agent's equipment, are placed beside the board for the time being. The object of the game is to "capture" any other player's "diplomatic bag" (FIG. 5) represented by a small model case placed on a specific marked square in each sector, that square being signified in any suitable manner, as for example by a large black dot.

To determine the sequence of play, the first die is thrown and the player with the highest number commences play. Of course, if two or more players throw the same number, then those players must throw again to decide which player commences.

The game is started by the first player throwing the die and moving his agent piece a number of squares clockwise around the outer peripheral section of the board equal to the number shown by the die. If the agent lands upon a square bearing a symbol as described above, the player has the option of taking the corresponding piece, e.g., the gun or the passport, and placing that piece on one of the five darker shaded squares in his sector adjacent his corner of the board. Each player must acquire five pieces in this manner, before he can take part in the second part of the game which is played on the central section of the board.

Figure 6:
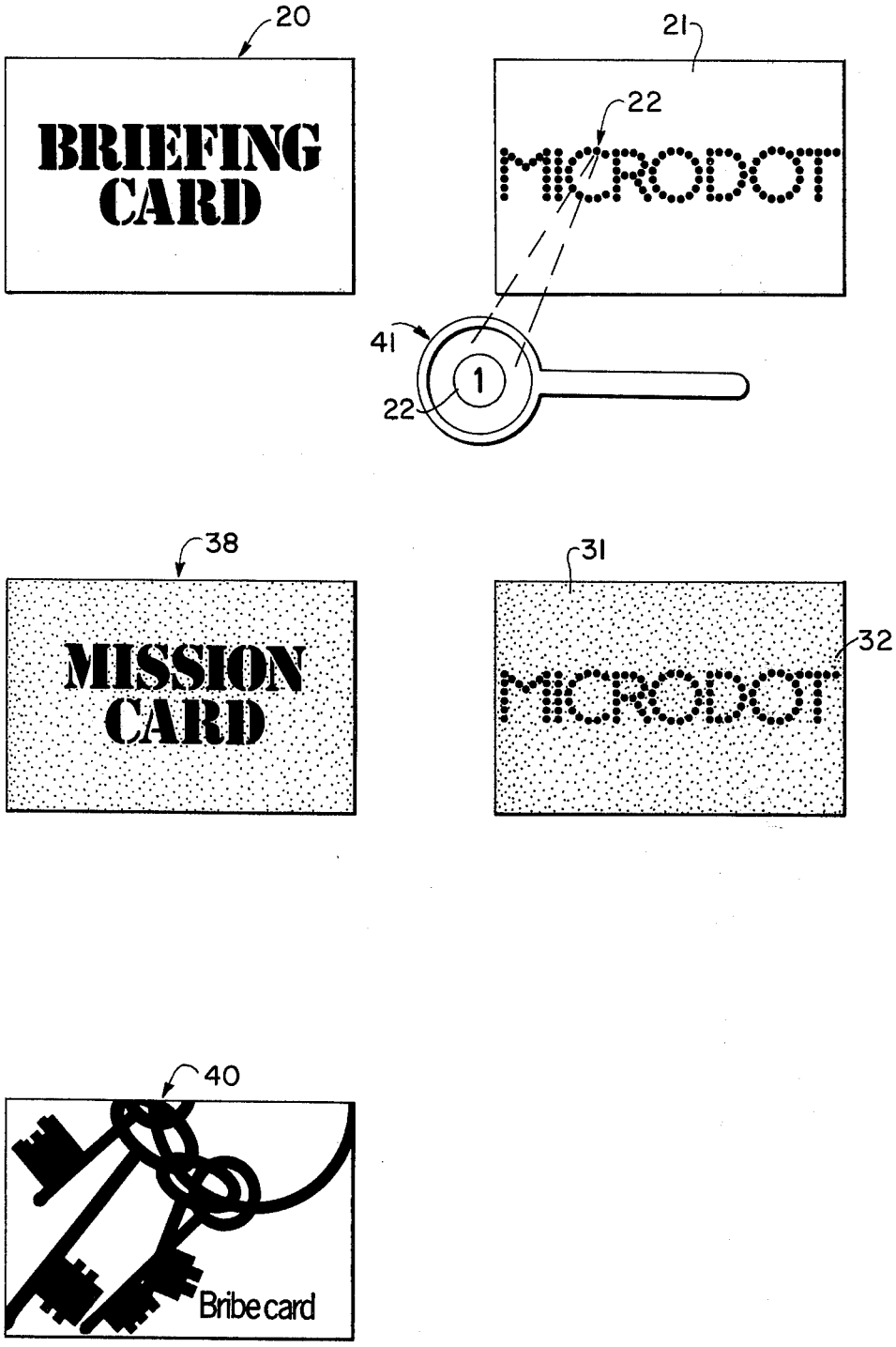
FIGS. 6 and 7 are diagrammatic representations, respectively, of cards and instruction charts which provide advantages and forfeits during play of the game.
Figure 7:
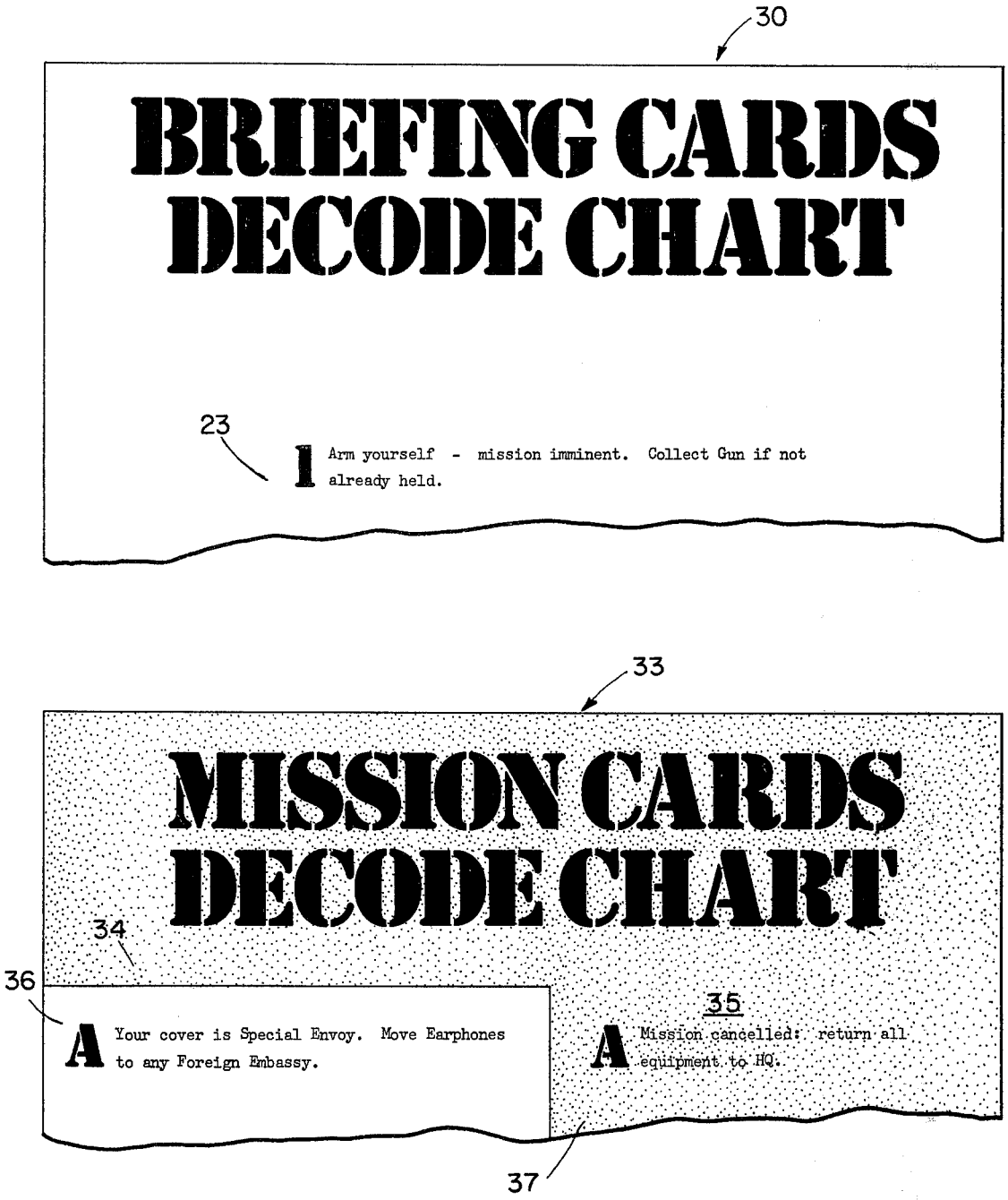

If, during the preliminary part of the game, when each player's agent is moving around the outer section of the board, the throw of the die causes the agent to land on a microdot square, labelled briefing card, the player must then pick up a card 20 from the top of a stack of white cards which are similarly labelled briefing card, and according to a symbol printed on the reverse side 21 of the card, obey an instruction, corresponding to that symbol, printed on a first chart 30 headed briefing cards decode chart. The symbol on the card is in the form of a number set in a dot 22 concealed in the word microdot as printed on the reverse side 21 of the card and spelled in dots, and of a size such that it must be viewed with the aid of a magnifying glass 41 (FIG. 6). (In one variation of the game it is a requirement that a player must have collected a specific piece of equipment before he is allowed to act on the instructions 23 set out in the chart). These instructions provide penalties or advantages depending upon which card is picked up and may provide, for example, for collecting another piece of equipment if it has not already been collected or for removing a piece of equipment if already collected. An example of a set of instructions 23 provided on a chart is as follows:

1. Arm yourself — mission imminent. Collect gun if not already held.

2. Establish enemy strength by undercover reconnaissance. Collect passport if not already held.

3. Previous missions indicate possibility of hand-to-hand fighting. Collect dagger if not already held.

4. Zero hour for mission brought forward. Take TWO turns.

5. You are sent on Assault Course training. Collect ladder if not already held.

6. You are warned of possible barbed wire barriers. Collect wirecutters if not already held.

7. You suffer from vertigo. Lose your ladder, if held.

8. Fault in last issue of radio receiver/transmitters. Lose your earphones, if held.

9. You are late for briefing session with Spymaster. Miss next turn.

10. You are awarded Special Agent rating. Collect any TWO pieces of equipment (or only one piece if only one is needed).

A card 20 when picked up and acted upon is then returned to the bottom of the stack. In the event that an instruction to a player is to "take two more turns", i.e., two throws of the die, and that player completes his set of five pieces of equipment with the first throw, then his second turn will be his first turn in the second stage of the game which is played in the central section of the board as hereinafter described.

At any point in this preliminary stage of the game, when a players's agent lands on one of the squares carrying symbols or microdots and that square is already occupied, then the newly-arrived agent is stopped from collecting the appropriate piece of equipment or taking a card from the stack.

Figure 1:
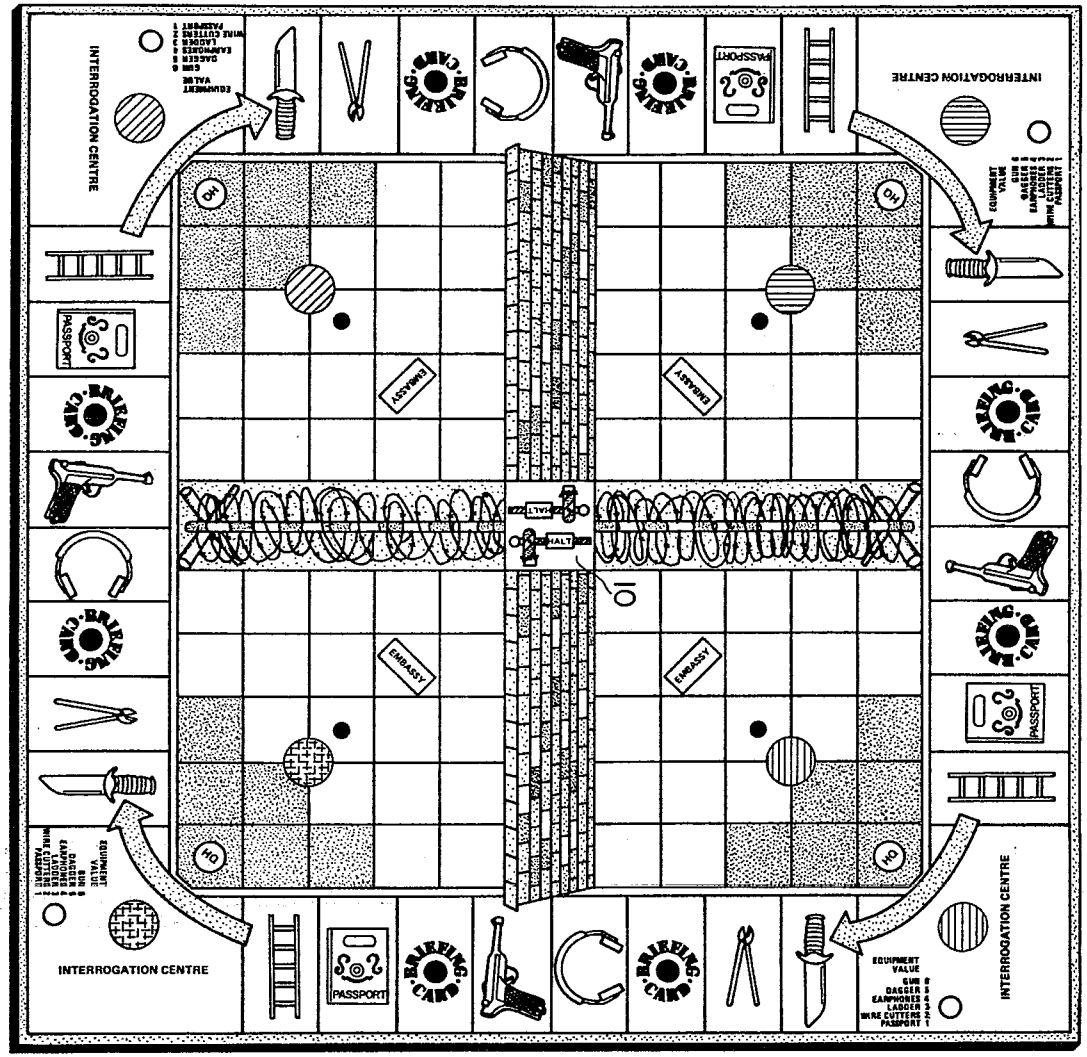
FIG. 1 is a diagrammatic representation of a board upon which the game is played.
Figure 2:
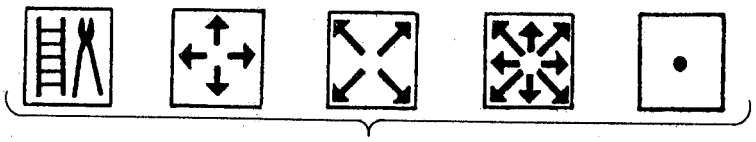
FIG. 2 shows the various choices which are provided on a die used in playing the game.

The second stage of the game commences as soon as any one player has collected his five pieces of equipment. The "agent" piece is placed on the square marked H.Q. and the player then throws a second die (FIG. 2) to make one of five possible choices, one of which appears twice on the die. These are indicated by symbols having the meaning described below as:

1. An upright cross (appears twice on the die) — move any pice of equipment one square forwards, backwards or sideways, 2. A diagonal cross — move any piece of equipment one square diagonally in any direction, 3. A combined upright and diagonal cross — move any piece of equipment one square in any direction.

4. A black dot.

5. A symbol of a ladder and wirecutters.

Figure 3:
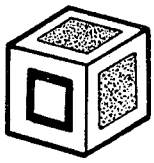
FIG. 3 shows diagrammatically the two choices provided on a further die used in playing the game.

Choices 1, 2 and 3 self-explanatory. Choice 4 however requires the player to pick up the top card of a second stack of cards 38 labelled mission card. The reverse side 31 of this card bears the word microdot formed by dots, one of which encloses a letter 32 which can be viewed with the aforementioned magnifying glass 41. A third die (FIG. 3) is then thrown, this third die having three black faces and three white faces. An instruction set out on a second chart 33 headed mission cards decode chart must then be acted upon, according to whichever letter is indicated on the card 38 and the random selection of a black or white face of the third die. To this end, the second chart 33, which can be one of a plurality of charts, is divided into two parts, one part, 34, associated with white and the other part, 35, with black. Each part of the chart has a number of instructions 36, 37 associated with key letters corresponding to the letters 32 on the cards 38. A typical set of instructions is as follows:

WHITE

A. Your cover is Special Envoy. Move Earphones to any foreign Embassy.

B. Your cover is U.N. observer. Move Passport to checkpoint.

C. Obtain one Bribe Card 40 and keep until required for an escape from any enemy prison. (Instruction: Freed equipment should be returned to H.Q.).

D. General mobilization. Move every piece of your equipment one square in any direction.

E. Assault Course expert joins you. Move Ladder adjacent to any barrier.

F. Local agent shows you a route to barrier unknown to enemy. Move Wirecutters adjacent to any barrier.

G. You are supplied with infra-red night sight for your gun. Move gun two squares in any direction.

H. Underground movement supplies you with maps. Move any piece of your equipment on foreign territory two squares.

I. It's a moonless night. You establish a breach in a barrier. Move either Wirecutters or Ladder onto any barrier.

J. Your knife-throwing training pays off. Move dagger two spaces in any direction.

BLACK

A. Mission cancelled: return all equipment to H.Q.

B. Passport invalid. Return to H.Q. for datestamping.

C. You have been foiled by a double agent. Your cover is blown. Return any Bribe Card 40 to pile.

D. Funds unavailable. Move every piece of your equipment back one square towards your own H.Q.

E. Ladder too short. Return ladder to H.Q.

F. Wirecutters blunt. Return Wirecutters to H.Q. for sharpening.

G. Stop to repair jammed gun. Miss this turn.

H. Enemy carries out intensive helicopter search for you. Miss this turn.

I. Car tire punctured by sniper's bullet. Miss this turn.

J. You cut yourself with your Dagger. Miss this turn.

A bribe card 40 is shown in FIG. 6.

Choice 5 requires the player to move either one of his pieces representing a ladder or wirecutters, when on a square immediately adjacent to one of the barriers, onto the barrier itself, whereafter, as far as that player's pieces are concerned, the barrier ceases to exist, and that player's pieces may then cross the barrier at any point along its length. Movement from a square on one side to a square on the other side of the barrier constitutes a single move.

Thus, during the course of the game each player can advance or retract, as he desires, one or more pieces on the squares of the central section of the board, no two pieces of the same player being allowed to occupy the same square.

In addition to crossing the barrier, one or more of a player's pieces can be moved into another player's sector through the central, common square which provides the checkpoint 10. To move onto and beyond this square each player must manoeuvre his passport piece onto the central square by throwing the second die to the appropriate choice when the piece is in the square next adjacent the central square, or by turning up a card bearing the letter B and simultaneously obtaining a white square on the third die after the second die has indicated a black dot. A player can not move his pieces through the checkpoint 10 unless his passport piece is on that square. Thus more than one passport piece can occupy this square.

When any one of a player's pieces has entered another player's sector, it can capture the opposing player's diplomatic bag (FIG. 5) by moving onto the square whereon the bag has been placed as and when the correct symbol is indicated by the second die. Thereafter the piece which has captured the diplomatic bag and the diplomatic bag piece itself are moved as one unit back towards the H.Q. square in its home sector, and the first player to achieve this feat wins the game.

However, during the course of the game, a player's piece, whether in possession of a diplomatic bag or not, can be removed from its position in a number of ways. It can be captured by an opposing piece of higher value in which case it is then removed to the capturing player's home square; in this event to retrieve his captured piece a player must move his agent around the peripheral section of the board in the same manner as in the preliminary stage of the game until the agent lands on the square appropriate to the captured piece, which is then released and returned to the respective H.Q. square. When a piece has been captured, a player can elect to abandon it, and replace it by the sixth piece of equipment which must be brought into the game in the same manner as in the preliminary stage. Cards can be provided in the mission card stack 38 which provide for immediate release of a piece without forfeit.

When a piece is moved onto a square already occupied by an opposing piece of equal value, then both pieces are considered to be captured and must be retrieved on the outer section of the board or replaced as described above as in the case when lower value pieces have been captured.

Each sector of the central section of the board has one of its squares marked as a safe square whereon a piece of equipment of an opposing player can be placed, in the normal course of play, and be immune from capture by any other piece unless the piece taking refuge is accompanied by a captured diplomatic bag piece. This square is marked by the word embassy.

What we claim is:

1. A board game comprising a board having a first section, said first section including a plurality of divisions bearing symbols of pieces collectable by a player and on which a preliminary stage of the game is played, and a second section on which a second stage of the game is played, a set of collectable pieces for each player which are movable on the second section of the board, a further piece for each player which, in playing the game, is moved along divisions of the first section to collect said pieces of the set of collectable pieces before that player can participate in the second stage of the game, and a still further piece for each player, the second section of the board being divided into a plurality of sectors and each sector being divided into a plurality of divisions for moving the pieces of each set across the board to secure the still further piece of an opposing player, said still further piece being located on a specific division of the opposing player's sector, and return it to a safe location, the game further comprising means for randomly controlling movement of each piece on the board, and card means for providing advantages and forfeits regulating playing of the game.

2. A board game according to claim 1 wherein the first section of the board is in the form of a peripheral circuit extending around the second section of the board.

3. A board game according to claim 1 wherein divisions of the first section of the board bear a symbol which indicates that an advantage or a forfeit is to be determined by said card means when a player's further piece lands thereon.

4. A board game according to claim 1 wherein the arrangement of the symbols on the first section of the board is regular.

5. A board game according to claim 1 wherein the means for randomly controlling movement of each further piece on the first section of the board includes a die for governing movement of each said further piece by throwing said die.

6. A board game according to claim 1 wherein the second section of the board is divided into four sectors each coloured for identification with the pieces associated with each player.

7. A board game according to claim 6 wherein said sectors are separated by artistic impressions of barriers across which the pieces of each of said sets can be moved from one sector to an adjacent sector.

8. A board game according to claim 1 wherein the means for randomly controlling the movement of each piece of each set of pieces includes a die having indicia representing a number of possible choices of movement indicated thereon, and a further choice providing for the use of said card means providing advantages and forfeits.

9. A board game according to claim 1 wherein each of the pieces of each set of pieces is distinct from the other pieces of the set.

10. A board game according to claim 9 wherein the pieces of each set of pieces are models of a gun, dagger, earphone headset, ladder, wirecutters and passport.

* * * * *